US012329251B2

(12) United States Patent
Zheng

(10) Patent No.: US 12,329,251 B2
(45) Date of Patent: Jun. 17, 2025

(54) WATCHBAND CONNECTOR

(71) Applicant: Yanghui Zheng, Shenzhen (CN)

(72) Inventor: Yanghui Zheng, Shenzhen (CN)

( * ) Notice: Subject to any disclaimer, the term of this patent is extended or adjusted under 35 U.S.C. 154(b) by 77 days.

(21) Appl. No.: 18/349,328

(22) Filed: Jul. 10, 2023

(65) Prior Publication Data

US 2025/0017333 A1 Jan. 16, 2025

(51) Int. Cl.
*A44B 11/26* (2006.01)
*A44C 5/20* (2006.01)

(52) U.S. Cl.
CPC ..... *A44C 5/2052* (2013.01)

(58) Field of Classification Search
CPC ..... A44B 11/26; A44B 11/258; A44B 11/266; Y10T 24/45775; Y10T 24/45785; Y10T 24/45791; Y10T 24/4782; Y10T 24/2155; A44C 5/2071; A44C 5/2052
See application file for complete search history.

(56) References Cited

U.S. PATENT DOCUMENTS

2014/0283346 A1* 9/2014 Mitchell, Jr. ..... A44B 11/16 24/68 E
2014/0339232 A1* 11/2014 Fiedler ..... E05B 47/0038 220/348
2016/0081439 A1* 3/2016 Catanese ..... A44B 11/226 63/3.1
2020/0229552 A1* 7/2020 Amsalem ..... G04G 17/02
2022/0295946 A1* 9/2022 Cheng ..... A44B 11/266
2022/0330664 A1* 10/2022 Li ..... A44B 11/258
2023/0202358 A1* 6/2023 Longenecker ..... A44B 11/258 24/303
2023/0363498 A1* 11/2023 Lu ..... A44B 11/266
2024/0225211 A1* 7/2024 Yang ..... A44C 5/20

* cited by examiner

*Primary Examiner* — Jason W San
*Assistant Examiner* — Michael S Lee

(57) ABSTRACT

A watchband connector includes a first fastener, and a second fastener arranged on the first fastener; wherein a clamping mechanism is arranged between the first fastener and the second fastener to fix the first fastener and the second fastener; the clamping mechanism includes a receiving slot defined on a top of the first fastener, and a limit member arranged in the receiving slot and fixed to the second fastener; the limit member is matched with the receiving slot; a connection assembly is arranged on the first fastener, to fasten the second fastener in the receiving slot.

12 Claims, 5 Drawing Sheets

WATCHBAND CONNECTOR

CROSS REFERENCE

The present disclosure claims priority of Chinese Patent Application No., filed on, the entire contents of which are hereby incorporated by reference in their entirety.

TECHNICAL FIELD

The present disclosure relates to the technical field of watchbands, and in particular to a watchband connector.

BACKGROUND

Conventional watchbands are generally metal chains, which are used in a connected state with a foldable clasp. The foldable clasp usually includes three segments, which are connected at the beginning and end and can be rotated and folded, such that it can be folded and snapped together to achieve fixation when in use. When being disassembled, the foldable clasp is rotated and unfolded to leave a margin for wrist release, but the watchband cannot be separated.

In order to match the wearing needs of smart watches, silicone watchbands and braided watchbands have become a new fashion. Such flexible watchband can be divided into two sections, one defining holes and the other arranged with a jack pin. When in use, the two sections of the watchband need to partially overlap in order to make the jack pin and a corresponding hole aligned and connected, and this structure appearance with a protrusion, leading to uncomfortable usage experience. When being disassembled, although the two sections of the watchband can be separated to facilitate storage, it is difficult to disassemble and inconvenient to operate with one hand.

SUMMARY OF THE DISCLOSURE

In order to overcome the shortcomings of the related art, the present disclosure provides a watchband connector that makes the watchband flat and firm at the joint when worn, and the watchband separates quickly when disassembled, enabling one-handed operation.

To solve the above technical problem, the present disclosure provides a watchband connector, including: a first fastener, and a second fastener arranged on the first fastener; wherein a clamping mechanism is arranged between the first fastener and the second fastener to fix the first fastener and the second fastener; the clamping mechanism includes a receiving slot defined on a top of the first fastener, and a limit member arranged in the receiving slot and fixed to the second fastener; the limit member is matched with the receiving slot; a connection assembly is arranged on the first fastener or the second fastener, to fasten the second fastener in the receiving slot.

In some embodiments, the connection assembly includes a movable push block arranged on an inner side of the receiving slot, and a connection platform fixed on a side of the movable push block; in a first position, the connection platform clamps the second fastener in the receiving slot.

In some embodiments, a movable snap is fixedly arranged at an end of the connection platform away from the movable push block, and a limit slot is defined on each of both ends of the second fastener; or a limit slot is fixedly defined at an end of the connection platform away from the movable push block, and a movable snap is arranged on each of both ends of the second fastener.

In some embodiments, a top side of the movable snap is movably connected to the limit slot, and the other top side of the movable snap is arranged with an inclined surface; a side wall of the limit slot is arranged with another inclined surface matching the inclined surface of the movable snap.

In some embodiments, a limit post is fixed at each of both ends on a side of the movable push block; an outer side of the limit post is arranged with a reset spring.

In some embodiments, an end of the reset spring is fixedly connected to the first fastener, and the other end of the reset spring is fixedly connected to the movable push block.

In some embodiments, a sliding limit slot is defined on the movable push block, and a limit vertical rod fixed with the first fastener is slidably arranged on an inside of the sliding limit slot.

In some embodiments, a first magnetic block is arranged in the middle of a side of the first fastener, and a second magnetic block is magnetically arranged at a top of the first magnetic block and fixed to the second fastener.

In some embodiments, each of the first magnetic block and the second magnetic block is made of rubidium magnet material and arranged in a cylindrical shape.

In some embodiments, the movable push block is arranged in a "凸" shape in cross section; the movable push block is slidable freely on the inner side of the receiving slot.

In some embodiments, a bottom of the limit member defines a recess matching the connection platform, and the connection platform is clamped into the recess when the limit member is inserted into another side of the receiving slot.

The present disclosure provides a watchband connector, which has the following beneficial effects compared with the related art.

1, the clamping mechanism is arranged to fasten the first fastener and the second fastener together, the watchband is adjusted to fit the thickness of the wearer's wrist, and the first fastener and the second fastener are fastened through the clamping mechanism and the connection assembly, such that the structure is reasonable and simple, which is conducive to a more smooth and even appearance after being connected by the connection assembly, thereby improving the comfort of wearing with the connection assembly, enhancing the practicality of the watchband connection, and avoiding the situation that a section of the watchband with a hole fits on the wrist when the wearer wears it and makes the wearer feel uncomfortable.

2, the connection assembly is arranged to further fasten the second fastener on the first fastener, the second fastener is affixed on the first fastener, the second fastener pushes the movable snap to the direction of the movable push block, and the top side of the movable snap goes into the inner side of the limit slot, such that the second fastener is fastened on the first fastener, enabling a more stable connection between the first fastener and second fastener when fixed. In addition, the operation of fastening the second fastener on the first fastener is more convenient and quick to use.

Numeral reference: 1, first fastener; 2, second fastener; 3, clamping mechanism; 31, receiving slot; 32, limit member; 33, first magnetic block; 34, second magnetic block; 35, limit slot; 36, connection assembly; 361, movable push block; 362, connection platform; 363, movable snap; 364, limit post; 365, reset spring; 366, sliding limit slot; 367, limit vertical rod.

DETAILED DESCRIPTION

The technical solutions in the embodiments of the present disclosure will be clearly and completely described below in conjunction with the accompanying drawings in the embodiments of the present disclosure, and it is clear that the described embodiments are only a part of the embodiments of the present disclosure, but not all of them. Based on the embodiments in the present disclosure, all other embodiments obtained by those skilled in the art without making creative labor fall within the scope of the present disclosure.

In the present disclosure, a first position refers to a state and a relative position of each structural member the when a first fastener and a second fastener are fixed.

Figure 1:
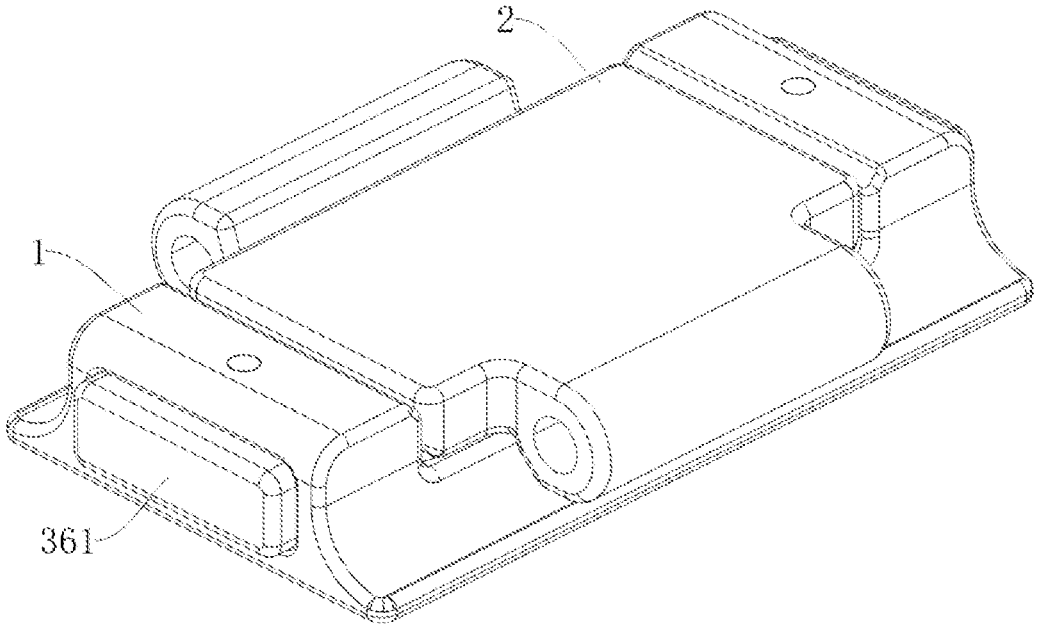
FIG. 1 is an overall structural schematic view according to the present disclosure.
Figure 2:
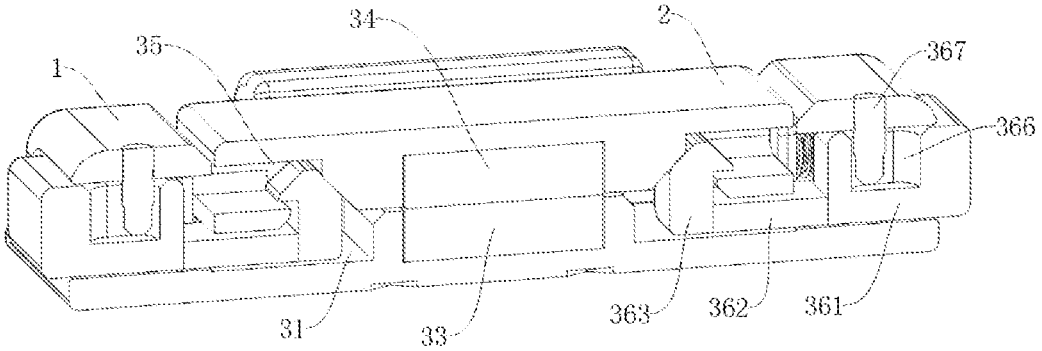
FIG. 2 is a three-dimensional cross-sectional view according to the present disclosure.
Figure 3:
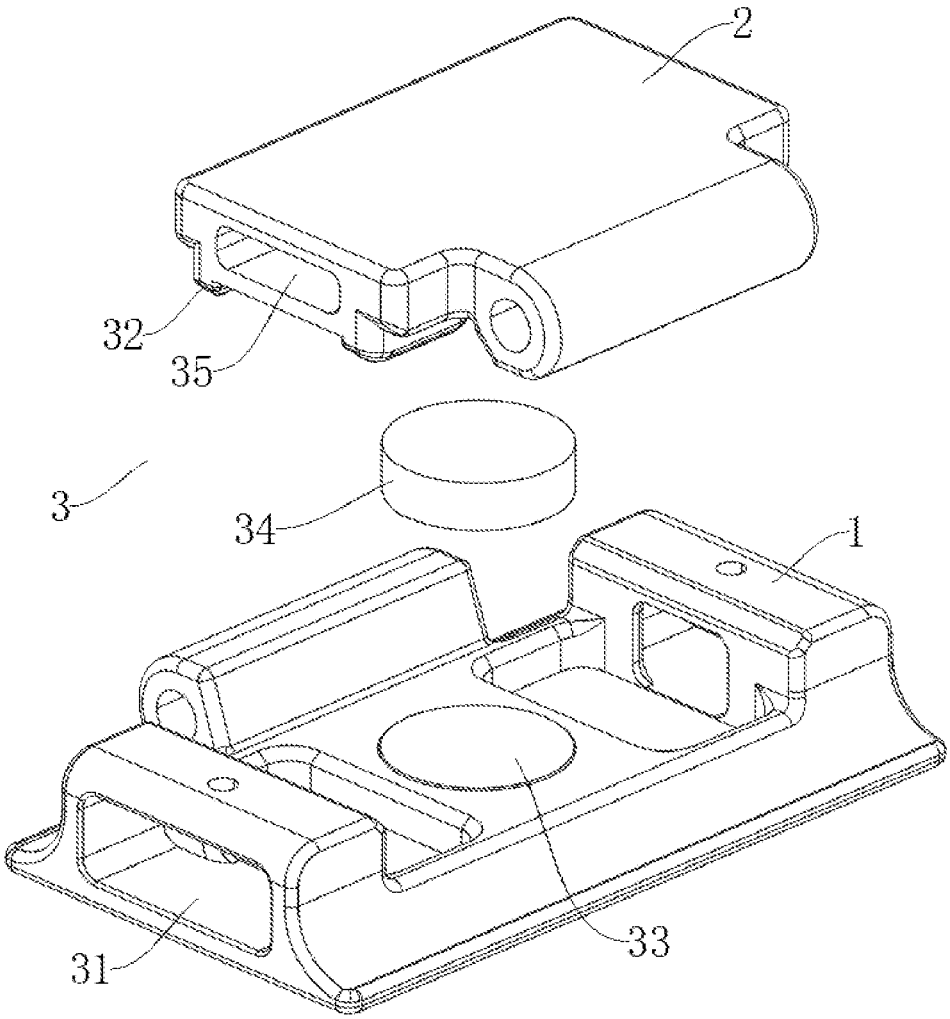
FIG. 3 is a partial exploded view of a clamping mechanism according to the present disclosure.

FIGS. 1-3 illustrate an embodiment of the present disclosure: a watchband connector, including a first fastener 1, and a second fastener 2 arranged on the first fastener 1; where the first fastener 1 is connected to a section of a watchband, and the second fastener 2 is connected to the other section of the watchband; a bottom of the first fastener 1 is arranged into a micro-arc surface, which is more conducive to fit with a wearer's wrist; a clamping mechanism 3 is arranged between the first fastener 1 and the second fastener 2 to fix the first fastener 1 and the second fastener 2.

As shown in FIGS. 3-7, the clamping mechanism 3 is configured to fasten the first fastener 1 and the second fastener 2 together, and after the watchband is adjusted to fit the thickness of the wearer's wrist, the first fastener 1 and the second fastener 2 are fastened and fixed by the clamping mechanism 3 and a connection assembly 36. In this way, the appearance is smoother and flatter after being connected by the connection assembly, which improves the comfort of wearing with the connection assembly.

The clamping mechanism 3 includes a receiving slot 31 defined on each top end of the first fastener 1, and a limit member 32 arranged in the receiving slot 31 and fixed to the second fastener 2; the limit member 32 is matched with the receiving slot 31; the limit member 32 is clamped on an inside of the receiving slot 31; a first magnetic block 33 is arranged in the middle of a side of the first fastener 1, and a second magnetic block 34 is magnetically arranged at a top of the first magnetic block 33 and fixed to the second fastener 2, both the first magnetic block 33 and the second magnetic block 34 being made of rubidium magnet material; the first magnetic block 33 and the second magnetic block 34 are both arranged in a cylindrical shape; magnetic property of an end of the first magnetic block 33 close to the second magnetic block 34 is opposite to magnetic property of an end of the second magnetic block 34 close to the first magnetic block 33; the first magnetic block 33 is fixed to the second magnetic block 34 by magnetic connection; a limit slot 35 is defined on each top end of the second fastener 2, the limit slot 35 could be a part of the limit member 32; the connection assembly 36 is arranged on the first fastener 1 or the second fastener 2, to fasten the second fastener 2 in the receiving slot 31. In some embodiments, the first magnetic block 33 and the second magnetic block 34 may both be arranged in a polygonal shape (e.g. square shape). In some embodiments, the first magnetic block 33 and the second magnetic block 34 include single-sided single-pole magnets, alternatively, the first magnetic block 33 and the second magnetic block 34 include single-sided multi-pole magnets.

When the second fastener 2 is affixed to the first fastener 1, the first magnetic block 33 on the first fastener 1 attracts the second magnetic block 34 on the second fastener 2 to move towards the first magnetic block 33, and the second fastener 2 is fixed to the first fastener 1 by the connection assembly 36 in the moving process.

The clamping mechanism 3 may further include a connection assembly 36 arranged in the receiving slot 31; as shown in FIG. 2, the first magnetic block 33 is fixed in the middle of a side of the first fastener 1, the second magnetic block 34 is fixed in the bottom of the second fastener 2, and the first magnetic block 33 and the second magnetic block 34 are fixed by magnetic connection; as shown in FIG. 3, which is an exploded view, the limit member 32 is arranged in the receiving slot 31 and fixedly connected to the second fastener 2, while a limit slot 35 is defined at each end of the second fastener 2, and the limit slot 35 is disposed on a top side of the limit member 32.

Figure 4:
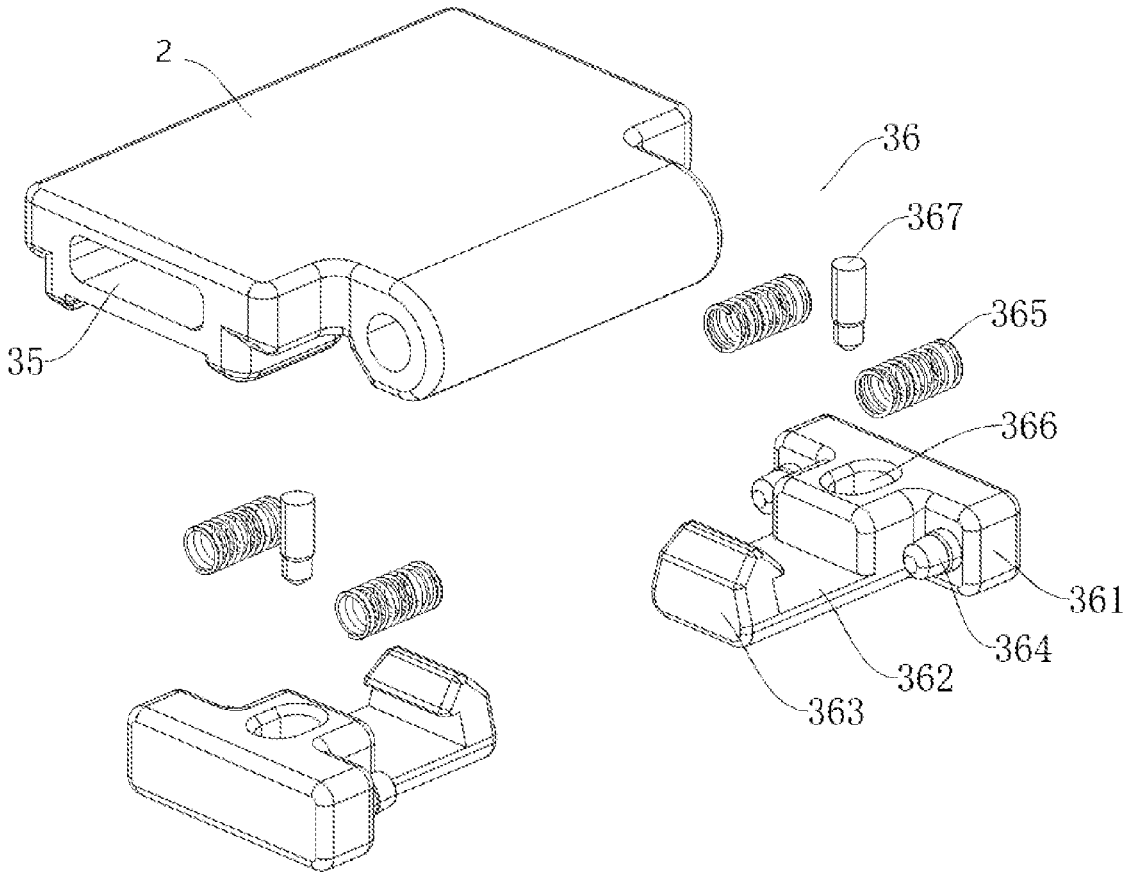
FIG. 4 is an exploded structural view of a connection assembly according to the present disclosure.

Specifically, as shown in FIG. 4, the connection assembly 36 includes a movable push block 361 arranged on an inner side of the receiving slot 31, and a connection platform 362 fixed on a side of the movable push block 361; in a first position, the connection platform 362 clamps the second fastener 2 in the receiving slot 31, and the movable push block 361 is arranged in a "ㄱㄱ" shape in cross section; the movable push block 361 is slidable freely on the inner side of the receiving slot 31; a bottom of the limit member 32 defines a recess matching the connection platform 362, and the connection platform 362 is clamped into the recess when the limit member 32 is inserted into the other side of the receiving slot 31; a movable snap 363 is fixedly arranged at an end of the connection platform 362 away from the movable push block 361, and the movable snap 363 is movably connected to the limit slot 35; a side of the movable snap 363 and a side of the limit slot 35 are arranged with matching inclined surfaces; when the second fastener 2 moves downward, the limit member 32 is driven to move downward, and since the inclined surface of the limit slot 35 on the bottom of the limit member 32 is matched with the inclined surface of the movable snap 363, the movable snap 363 is caused to move in a horizontal direction.

Figure 5:
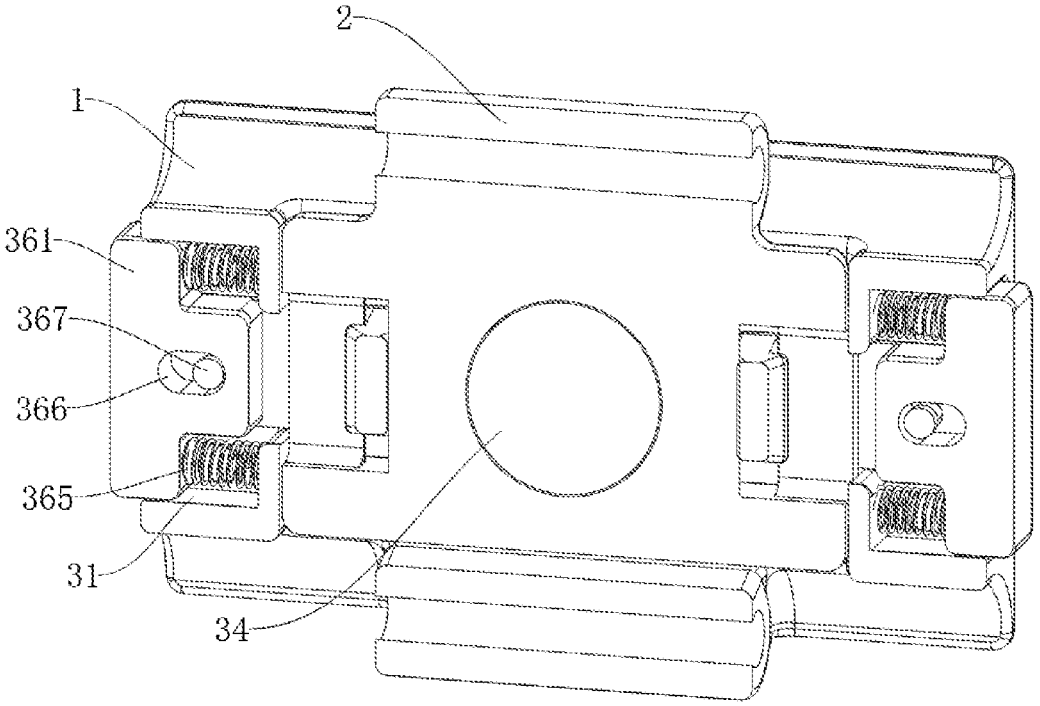
FIG. 5 is a top three-dimensional cross-sectional view according to the present disclosure.
Figure 6:
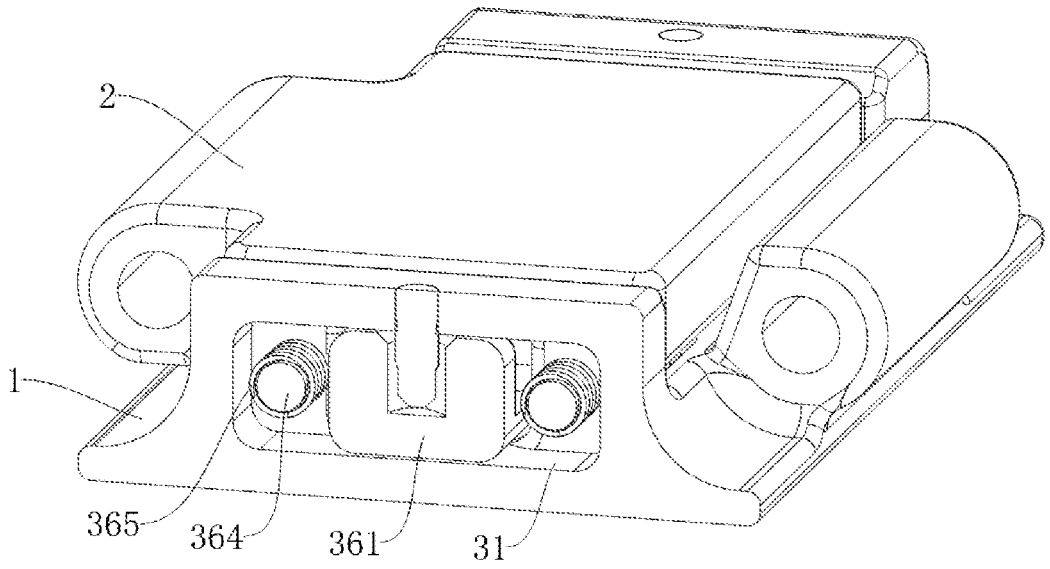
FIG. 6 is a side three-dimensional cross-sectional view according to the present disclosure.
Figure 7:
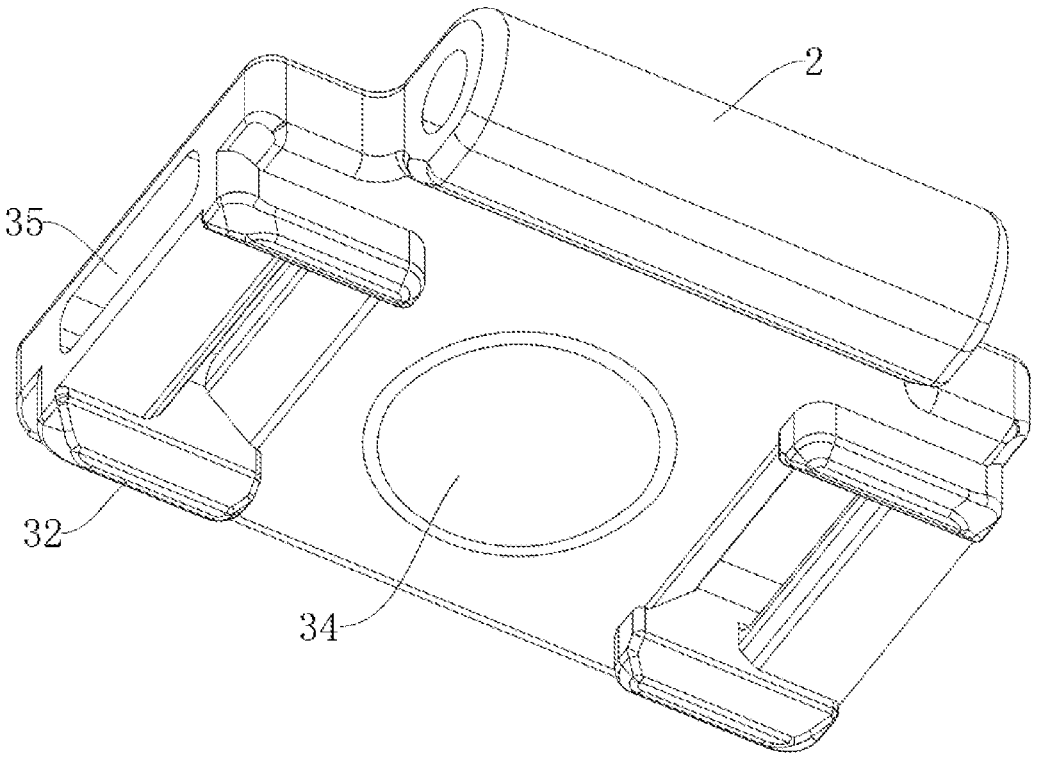
FIG. 7 is a structural schematic view of a second fastener according to the present disclosure.

As shown in FIG. 5, a sliding limit slot 366 is defined on the movable push block 361, and a limit vertical rod 367 fixed with the first fastener 1 is slidably arranged on an inside of the sliding limit slot 366; when the movable push block 361 slides in the receiving slot 31, the movable push block 361 is positionally limited by the limit vertical rod 367 to prevent the movable push block 361 from falling off; a limit post 364 is fixed at each of both ends on a side of the movable push block 361; an outer side of the limit post 364 is arranged with a reset spring 365 fixed to the first fastener 1; an end of the reset spring 365 is in contact with a side wall of the receiving slot 31, and the other end of the reset spring 365 is fixedly connected to the movable push block 361; the reset spring 365 sleeved on the limit post 364 is configured to adjust a position of the movable push block 361; when the two movable push blocks 361 move in two opposite directions respectively, the movable push block 361 pulls the position of the movable push block 362. When the two movable push blocks 361 move in two opposite directions, the movable push blocks 361 pull the reset springs 365, and the reset springs 365 produce elastic deformation to be stretched so as to facilitate the reset of the position of the movable push blocks 361.

In the embodiments, when connecting the watchband, the second fastener 2 is affixed to the first fastener 1, and the limit members 32 at both ends of the second fastener 2 are disposed corresponding to the receiving slots 31 at both ends of the first fastener 1; the second magnetic block 34 on the second fastener 2 is attracted by the first magnetic block 33 on the first fastener 1 to move toward the first magnetic block 33, and the second magnetic block 34 drives the second fastener 2 to move downward, the second fastener 2 driving the limit members 32 on the two ends of the bottom of the second fastener 2 to move downward; due to the fact that the inclined surface of the limit slot 35 on the bottom of the limit member 32 is matched with the inclined surface of the movable snap 363, the two limit members 32 respectively push two movable snaps 363 to move in horizontally in opposite directions; the movable snap 363 is clamped into the limit slot 35, and the second fastener 2 is clamped in the first fastener 1; in addition, the movable snap 363 push the corresponding connection platform 362 to move, the connection platform 362 pushes the corresponding movable push block 361 to slide in the inner side of the receiving slot 31, the movable push block 361 pulls the reset spring 365, the reset spring 365 generates elastic deformation to be stretched, and the movable push block 361 extends out of the receiving slot 31; in addition, the first magnetic block 33 and the second magnetic block 34 are fixed by magnetic connection, and the second fastener 2 is further fixed on the first fastener 1.

In addition to the above-mentioned embodiments, another deformed embodiment is provided as follows. For example, the limit slot 35 is defined on the first fastener 1, while the movable snap 363 is arranged on the second fastener 2. That is, when the movable push block 361 is moving, the limit slot 35 is driven to move, while the movable snap 363 is fixed. This structure is just the opposite of the above-mentioned embodiments but can obtain the same function.

In some embodiments, in order to adapt to different watchband size requirements, the size of the watchband connector is optimized.

In some embodiments, the watchband connector is used for the connection of a single-sided watchband, where only the front of the watchband has a decorative layer, which is suitable for wearing and displaying outside, the length*width*thickness of the watchband connector is (20-25)*(12-17)*(2-5) mm. As shown in FIG. 1, the first fastener can be made longer and wider to meet the size requirements and at the same time used as a decorative layer on the front, the second fastener is made smaller so that it can be better hidden. In the actual product development process of some embodiments, the length*width*thickness of the strap connector is specifically 23.6*15.2*4 mm.

In some embodiments, the watchband connector is used to connect a double-sided watchband where the user can remove the watchband and turn it over to wear, the length*width*thickness of the watchband connector is (24-29)*(16-22)*(2-5) mm, both the first and second fasteners can be made wider and longer, so as to support more decorative materials on the surfaces. In the actual product development process of some embodiments, the length*width*thickness of the watchband connector is specifically 26*19.9*4 mm, the thickness may remain unchanged comparing to the watchband connector used to connect the single-sided watchband, the length and width are extended so as to be more convenient to decorate. By using the watchband connector to connect double-sided watchbands, easy disassembly and aesthetically appealing double-sided appearance can be achieved.

More specifically, when applied to a double-sided watchband, different colors/symbols can be put on the surfaces of the first fastener and the second fastener, so as to help users distinguish and choose which panel is facing outward. In a specific application example, different emoticons/weather symbols/mood symbols/personalized signatures/customized stickers are put on the surfaces of the first fastener and the second fastener, so as to meet the various preferences of users.

In some embodiments, the clasp connector is made of fiber materials, including but not limited to man-made fiber materials such as carbon fiber, aramid fiber, glass fiber, or natural hemp fiber. The application of one or more of these materials make the watchband connector sturdier and more wear-resistant.

Although the embodiments of the present disclosure have been shown and described, it is understood to those skilled in the art that a variety of variations, modifications, replacements, and variants of these embodiments can be made without departing from the principles and spirit of the present disclosure, the scope of which is limited by the appended claims and their equivalents.

What is claimed is:

1. A watchband connector, comprising:

a first fastener (1), and a second fastener (2) arranged on the first fastener (1);

wherein a clamping mechanism (3) is arranged between the first fastener (1) and the second fastener (2) to fix the first fastener (1) and the second fastener (2);

the clamping mechanism (3) comprises a receiving slot (31) defined on a top of the first fastener (1), and a limit member (32); in a first position, the limit member (32) is arranged in the receiving slot (31) and fixed to the second fastener (2), and the limit member (32) is matched with the receiving slot (31); a connection assembly (36) is arranged on the first fastener (1) to fasten the second fastener (2) in the receiving slot (31);

the connection assembly (36) comprises a movable push block (361) arranged on an inner side of the receiving slot (31), a connection platform (362) fixed on a side of the movable push block (361), a limit post (364) fixed at each of both ends on a side of the movable push block (361) and a reset spring (365) arranged on outer side of the limit post (364); in the first position, the connection platform (362) clamps the second fastener (2) in the receiving slot (31);

a limit post (364) is fixed at each of two ends on a side of the movable push block (361); an outer side of the limit post (364) is arranged with a reset spring (365).

2. The watchband connector according to claim 1, wherein a movable snap (363) is fixedly arranged at an end of the connection platform (362) away from the movable push block (361), the second fastener (2) has a first end and a second end, and a limit slot (35) is defined on each of both ends of the second fastener (2).

3. The watchband connector according to claim 2, wherein a top side of the movable snap (363) is movably connected to the limit slot (35), and an other top side of the movable snap (363) is arranged with an inclined surface; a side wall of the limit slot (35) is arranged with another inclined surface matching the inclined surface of the movable snap (363).

4. The watchband connector according to claim 1, wherein an end of the reset spring (365) is fixedly connected to the first fastener (1), and an other end of the reset spring (365) is fixedly connected to the movable push block (361).

5. The watchband connector according to claim 1, wherein a sliding limit slot (366) is defined on the movable push block (361), and a limit vertical rod (367) fixed with the first fastener (1) is slidably arranged on an inside of the sliding limit slot (366).

6. The watchband connector according to claim 1, wherein a first magnetic block (33) is arranged in a middle of a side of the first fastener (1), and a second magnetic block (34) is magnetically arranged at a top of the first magnetic block (33) and fixed to the second fastener (2).

7. The watchband connector according to claim 6, wherein each of the first magnetic block (33) and the second magnetic block (34) is made of rubidium magnet material and arranged in a cylindrical shape.

8. The watchband connector according to claim 1, wherein a bottom of the limit member (32) defines a recess matching the connection platform (362), and the connection platform (362) is clamped into the recess when the limit member (32) is inserted into another side of the receiving slot (31).

9. The watchband connector according to claim 1, wherein the watchband connector is configured to connect a single-sided watchband, only a front of the single-sided watchband has a decorative layer, a length*width*thickness of the watchband connector is (20-25)*(12-17)*(2-5) mm.

10. The watchband connector according to claim 1, wherein the watchband connector is configured to connect a double-sided watchband, both a front of the double-sided watchband and a back of the double-sided watchband have decorative layers, a length*width*thickness of the watchband connector is (24-29)*(16-22)*(2-5) mm.

11. A watchband connector, comprising:

a first fastener (1), and a second fastener (2) arranged on the first fastener (1);

wherein a clamping mechanism (3) is arranged between the first fastener (1) and the second fastener (2) to fix the first fastener (1) and the second fastener (2);

the clamping mechanism (3) comprises a receiving slot (31) defined on a top of the first fastener (1), and a limit member (32); in a first position, the limit member (32) is arranged in the receiving slot (31) and fixed to the second fastener (2), and the limit member (32) is matched with the receiving slot (31); a connection assembly (36) is arranged on the first fastener (1) to fasten the second fastener (2) in the receiving slot (31);

the connection assembly (36) comprises a movable push block (361) arranged on an inner side of the receiving slot (31), a connection platform (362) fixed on a side of the movable push block (361), a limit post (364) fixed at each of both ends on a side of the movable push block (361) and a reset spring (365) arranged on outer side of the limit post (364); in the first position, the connection platform (362) clamps the second fastener (2) in the receiving slot (31);

a sliding limit slot (366) is defined on the movable push block (361), and a limit vertical rod (367) fixed with the first fastener (1) is slidably arranged on an inside of the sliding limit slot (366).

12. A watchband connector, comprising:

a first fastener (1), and a second fastener (2) arranged on the first fastener (1);

wherein a clamping mechanism (3) is arranged between the first fastener (1) and the second fastener (2) to fix the first fastener (1) and the second fastener (2);

the clamping mechanism (3) comprises a receiving slot (31) defined on a top of the first fastener (1), and a limit member (32); in a first position, the limit member (32) is arranged in the receiving slot (31) and fixed to the second fastener (2), and the limit member (32) is matched with the receiving slot (31); a connection assembly (36) is arranged on the first fastener (1) to fasten the second fastener (2) in the receiving slot (31);

the connection assembly (36) comprises a movable push block (361) arranged on an inner side of the receiving slot (31), a connection platform (362) fixed on a side of the movable push block (361), a limit post (364) fixed at each of both ends on a side of the movable push block (361) and a reset spring (365) arranged on outer side of the limit post (364); in the first position, the connection platform (362) clamps the second fastener (2) in the receiving slot (31);

a bottom of the limit member (32) defines a recess matching the connection platform (362), and the connection platform (362) is clamped into the recess when the limit member (32) is inserted into another side of the receiving slot (31).

* * * * *